US007806776B2

(12) United States Patent
Lickfold

(10) Patent No.: US 7,806,776 B2
(45) Date of Patent: Oct. 5, 2010

(54) DETACHABLE CUE TIP ASSEMBLIES AND CUE STICKS HAVING SAME

(76) Inventor: Neil Lickfold, 116 Ziegler St., Zelienople, PA (US) 16063

( * ) Notice: Subject to any disclaimer, the term of this patent is extended or adjusted under 35 U.S.C. 154(b) by 0 days.

(21) Appl. No.: 12/381,961

(22) Filed: Mar. 18, 2009

(65) Prior Publication Data

US 2009/0253525 A1 Oct. 8, 2009

Related U.S. Application Data

(63) Continuation-in-part of application No. 12/070,634, filed on Feb. 20, 2008, now Pat. No. 7,549,928.

(51) Int. Cl.
*A63D 15/12* (2006.01)

(52) U.S. Cl. ..... 473/49; 473/46

(58) Field of Classification Search ..... 473/44–51
See application file for complete search history.

(56) References Cited

U.S. PATENT DOCUMENTS

| | | | | | |
|---|---|---|---|---|---|
| 52,128 | A | * | 1/1866 | Bevitt | 473/49 |
| 250,861 | A | * | 12/1881 | Williams et al. | 473/49 |
| 364,680 | A | * | 6/1887 | Sherwood | 473/47 |
| 860,381 | A | * | 7/1907 | Holden | 473/49 |
| 934,162 | A | * | 9/1909 | Gormon | 473/49 |
| 985,067 | A | * | 2/1911 | Sacket | 473/49 |
| 1,013,671 | A | * | 1/1912 | Masgai | 473/49 |
| 1,077,664 | A | * | 11/1913 | Ankenmann | 473/49 |
| 1,139,340 | A | * | 5/1915 | Ciarelli | 473/49 |
| 1,141,587 | A | * | 6/1915 | Smith | 473/49 |
| 1,184,096 | A | * | 5/1916 | Hirst | 473/50 |
| 1,201,677 | A | * | 10/1916 | Bechle | 473/49 |
| 1,257,249 | A | * | 2/1918 | Koch | 473/49 |
| 1,340,395 | A | * | 5/1920 | Leger | 473/49 |
| 1,349,069 | A | * | 8/1920 | Kosinski | 473/49 |
| 1,429,752 | A | * | 9/1922 | Medvec | 473/49 |
| 1,476,622 | A | * | 12/1923 | Kirk | 473/51 |
| 1,532,985 | A | * | 4/1925 | Bradley | 473/49 |
| 1,544,696 | A | * | 7/1925 | Sprenkel | 473/49 |
| 1,558,740 | A | * | 10/1925 | Mallory | 473/49 |
| 1,559,569 | A | * | 11/1925 | Gerenda | 473/49 |
| 1,614,414 | A | * | 1/1927 | Vargo | 473/49 |
| 2,544,970 | A | * | 3/1951 | Watson | 473/49 |
| 3,226,119 | A | * | 12/1965 | Foy | 473/49 |
| 3,320,986 | A | * | 5/1967 | Jeffery et al. | 30/167 |
| 3,580,576 | A | * | 5/1971 | Merola | 473/49 |

(Continued)

*Primary Examiner*—Mark S Graham
(74) *Attorney, Agent, or Firm*—IP & Internet Law North, LLC; Thomas Lizzi

(57) ABSTRACT

A replaceable cue tip assembly is provided to enable the easy and quick replacement of tip pads of cue sticks. The cue tip assembly includes a tip ferrule that is attachable to a cue stick shaft or to conventional shaft ferrule. It also includes a tip pad holder to which a tip pad is to be fixed. The tip pad holder has a non-threaded conical surface that seats upon a mating non-threaded conical surface of the tip ferrule. The outside diameter of the tip ferrule may be less than local thickness of the cue shaft under certain conditions. Various means of connecting the tip pad holder and the tip ferrule together are disclosed. Cue sticks having the replaceable cue tip assemblies are also disclosed as are tip pad holder tools for use in attaching and removing the tip pad holders.

18 Claims, 5 Drawing Sheets

U.S. PATENT DOCUMENTS

| | | | | |
|---|---|---|---|---|
| 4,934,883 | A * | 6/1990 | Andersson et al. | 409/234 |
| 5,462,490 | A * | 10/1995 | Donwen | 473/49 |
| 5,725,437 | A * | 3/1998 | McCarty et al. | 473/49 |
| 6,183,371 | B1 * | 2/2001 | Wethered | 473/46 |
| 6,251,024 | B1 * | 6/2001 | Summers et al. | 473/49 |
| 6,719,638 | B2 * | 4/2004 | Wethered | 473/49 |
| 6,881,153 | B2 * | 4/2005 | Andrews | 473/47 |
| 7,097,570 | B2 * | 8/2006 | Gulyassy | 473/49 |
| 7,169,055 | B2 * | 1/2007 | Mekosh | 473/43 |
| 7,549,928 | B1 * | 6/2009 | Lickfold | 473/49 |
| 2007/0066411 | A1 * | 3/2007 | Gulyassy | 473/44 |
| 2007/0219009 | A1 * | 9/2007 | Sullivan | 473/49 |

* cited by examiner

FIG. 1A (PRIOR ART)
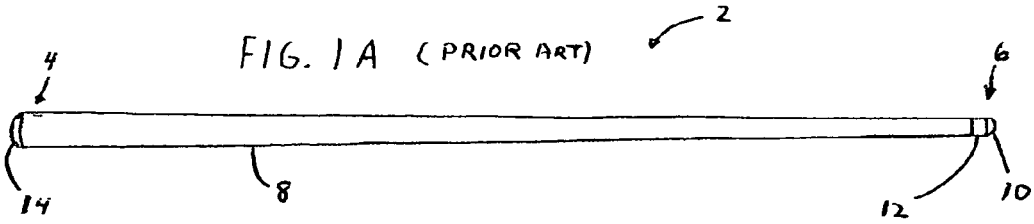
FIG. 1B
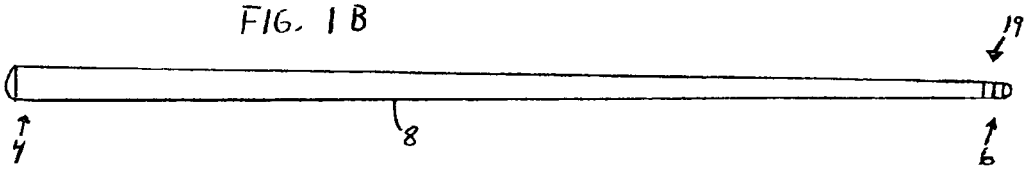
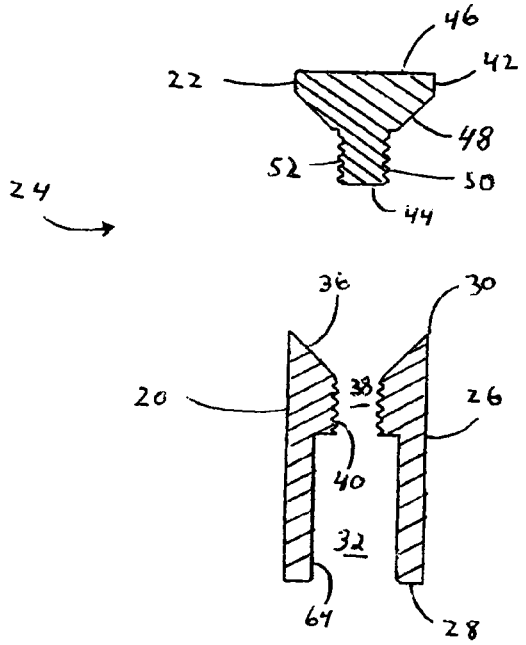
FIG. 2
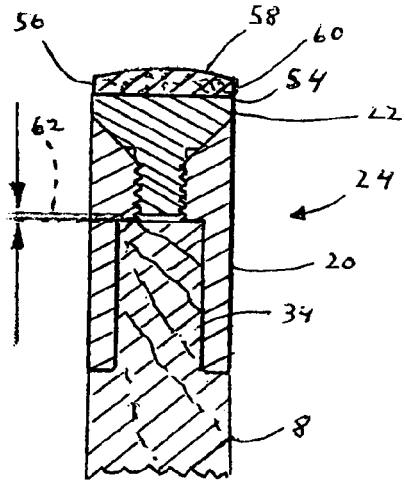
FIG. 3

DETACHABLE CUE TIP ASSEMBLIES AND CUE STICKS HAVING SAME

CROSS-REFERENCE TO RELATED APPLICATIONS

This application is a continuation-in-part of application Ser. No. 12/070,634 which was filed on Feb. 20, 2008, now U.S. Pat. No. 7,549,928 and is hereby incorporated herein by reference.

BACKGROUND OF THE INVENTION

1. Field of the Invention

The present invention relates to novel detachable tip assemblies for cue sticks. It also relates to cue sticks having such novel detachable tip assemblies.

2. Description of the Related Art

Players of billiards and pool and similar billiard table games use cue sticks for striking balls during the course of play. A cue stick has a grip end and a striking end. The striking end is typically fitted with a shaft ferrule to which an impact-protection tip pad is attached by an adhesive. A shaft ferrule is often referred to in the art simply as a "ferrule," but the term "shaft ferrule" is used herein and in the appended claims for greater clarity when reference is being made to the conventional cue stick ferrule. The shaft ferrule absorbs some of the shock during ball striking thereby protecting the cue stick shaft from impact damage, e.g., splitting. Shaft ferrules are typically made of high-impact materials that are resistant to cracking, chipping, and breaking, e.g., brass, ivory, carbon fiber, plastics such as melamine resin, aegis, or phenolic resin.

The tip pad is often referred to in the art simply as the "tip", but the term "tip pad" is used herein and in the appended claims for greater clarity. The tip pad provides the interface during striking between the ball and the rest of the cue stick. Tip pads typically have the shape of a disc or a short cylinder. One face of the cylinder is typically flat and seats upon the outer face of the shaft ferrule to which it is held in place by a bonding layer of an adhesive. The other cylinder face is the striking face of the tip pad and usually has a convex shape with a desired degree of curvature.

Tip pads come in different hardnesses and with different diameters and striking face curvatures. Hard tip pads are favored for high-impact shots, e.g., breaking shots, and may be made of phenolic resin or leather. Softer tip pads are favored for placement shots, especially when the player desires to put spin on the ball being struck. Softer tip pads are typically made of multiple layers of compressed-together leather, although one-piece leather tip pads are sometimes used. The level of hardness that a multiple-layer leather tip pad has depends on the amount compression pressure that was used in making it, the greater the compression, the greater the hardness.

Tip pad diameters vary within ranges which are related to the type of game for which the cue stick is intended for use and an individual player's preference. Cue sticks which are intended for use in playing pool usually have tip pad diameters of between about 11 to about 14 millimeters, with 13 millimeter being the most common. Cue sticks which are intended for use in playing snooker generally have tip pads of smaller diameters, the most common being 9.5 millimeters.

The radius of curvature that a tip pad has on its striking face is preferably chosen to correspond to the amount of spin that the player desires to put on the struck ball. Lesser degrees of curvature provide for less spin, especially accidental spin, thus yielding straighter shots, e.g., for breaking. Higher degrees of curvature make it easier to impart spin to the struck ball. The degree of curvature varies inversely with the radius of the curvature. The radii of curvature typically used for striking faces are those corresponding to three United States coins, i.e., the dime (8.95 millimeters), the nickel (10.6 millimeters), and the quarter (12.15 millimeters).

The striking face of a tip face is usually made with a controlled level of surface roughness. Greater roughness provides for better ball gripping during impact thereby making it easier to impart spin to the struck ball. Smoother tip pads make it less likely that spin will be accidentally imparted to the struck ball.

Repeated ball impact causes wear damage to the tip pad. The shape of the striking face will change, often flattening and becoming distorted. The tip pad may also mushroom out over the side of the shaft ferrule. The striking surface also becomes smoother making it more difficult to control the amount of spin given to the struck ball. High impact shots, such as breaking shots, are particularly damaging. As the tip pad damage accumulates, the player's shooting accuracy is likely to decrease. Cue chalk is typically applied to the striking face of the tip pad before every shot as a means of both decreasing the rate of damage accumulation and compensating for the damage already present. Shaping tools are sometimes used to partially restore the shape and surface roughness of the tip pad by cutting or abrading the tip pad. However, shaping tools are of limited effectiveness and can only be used a finite number of times before too little tip pad remains to be worked upon.

Compounding the problem of tip pad wear damage are rules of play that sometime prevent a player from changing cue sticks during the play of a game.

Conventionally, a damaged tip pad can be removed by breaking or dissolving the adhesive layer that holds the tip pad to the shaft ferrule or by cutting away the tip pad. Once removed, a new tip pad can be glued into place. However, this method of repair is time-consuming and is often inconvenient to conduct, especially during the play of a game.

Over the years, there have been numerous attempts to address the problem of tip pad damage through different schemes for improving the replaceability of the tip pads. Examples of such schemes are disclosed in U.S. Pat. Nos. 7,097,570 B2, 6,719,638 B2, 6,183,371 B1, 5,462,490, 3,580,576, 3,226,119, 2,544,970, 1,614,414, 1,544,696, 1,532,985, 1,476,622, 1,429,752, 1,340,395, 1,257,249, 1,141,587, 1,077,664, 1,013,671, 985,067, 934,162, and 52,128, as well as in U.S. Patent Application Publication Nos. US 2007/0219009 A1, and US 2007/0066411 A1. However, all of these schemes suffer from one or more of the following disadvantages: undue complexity, added heaviness, and proneness to unintended loosening of the component holding the tip pad.

SUMMARY OF THE INVENTION

An objective of the present invention is to overcome at least some of the aforementioned problems of the prior art by providing an improved replaceable cue tip. Another objective of the present invention is to provide improved removable tip assemblies for cue sticks.

One aspect of the present invention provides a novel and simple replaceable tip assembly for the striking end of a cue stick. The inventive tip assemblies comprise a tip ferrule and a tip pad holder which mate together along a conical surface junction, with the conical surface one of these components being concave to receive the convex conical surface of the other. It is to be understood that the term "tip ferrule" is used herein and in the appended claims to refer to the ferrule component of the present invention and is to be distinguished from the shaft ferrule of the prior art. The conical surface junction provided by the present invention extends to the outer diameter of the tip pad holder and of the tip ferrule, thus assuring that the impact load from ball striking will be distributed substantially uniformly across the diameter of the tip ferrule, without deflection of the tip pad holder, and thereafter into the cue stick shaft. The conical surface shape of the conical surface junction increases the area of surface contact of the junction and controllably resolves the impact force into lateral and axial components of force to the junction.

Although, some prior art replaceable tips incorporate a partial conical surface junction into their designs, e.g., the replaceable tip taught by U.S. Pat. No. 3,580,576, such partial conical surface junctions include a substantially radially-oriented land area or areas which, unless extreme precision is achieved during the machining of the land and conical portions of both of the involved mating components, would either prevent the conical surfaces from actually contacting one another or would themselves be kept out of contact with each other by the contacting of the conical surfaces. Either case results in less than optimal distribution of the impact force across the entire expected junction area as it is instead being born by only one or other of the land surface contact or the conical surface contact.

An additional advantage of the conical surface junction of the present invention is that it provides for an automatic concentric alignment of the tip pad and cue stick shaft without the need for a truing operation on a cue lathe. Another advantage of the present invention is that it permits the mass production of cue shafts which allow the user to interchange different tip pads.

Importantly, the inventor has found the surprising result that the combination of the aforementioned features of the present invention greatly reduces or eliminates the incidence of loosening of the component holding the tip pad during play compared to prior art replaceable tips.

Preferably, in the present invention, the apex regions of the respective mating conical surfaces of the tip ferrule and the tip pad holder comprise a complementary mortise and tenon set which mate together without the end face of the tenon contacting the bottom face of the mortise. The mortise and tenon may include complementary threads which reversibly engage to permit the tip ferrule and tip pad holder to screw together and apart. Alternatively, the mortise and tenon may be designed to connect together in a bayonet joint fashion or in a cam-lock fashion, e.g., such as with the cam-lock design disclosed in U.S. Pat. No. 4,934,883.

Some embodiments of the present invention also include a tip pad holder tool to aid in reversibly attaching the tip pad holder to the tip ferrule. Such tip pad holder tools have an outer surface adapted to be manually gripped and an inner surface adapted to reversibly fit in interference contact with the cylindrical outer surface of the tip pad holder.

Another aspect of the present invention provides cue sticks having the aforementioned novel replaceable tip assemblies.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention.

FIG. 1A. is a schematic side view of a conventional cue stick.

FIG. 1B is a schematic side view of a cue stick according to an embodiment of the present invention.

FIG. 2. is a schematic cross-sectional view along the longitudinal center plane of the components of a tip assembly having a threaded mortise-tenon fastening according to a first embodiment of the present invention.

FIG. 3 is a schematic cross-sectional view along the longitudinal center plane of the components of the tip assembly of FIG. 2 mounted together upon a cue shaft and with a tip pad attached to the tip pad holder.

DESCRIPTION OF PREFERRED EMBODIMENTS

Figure 4:
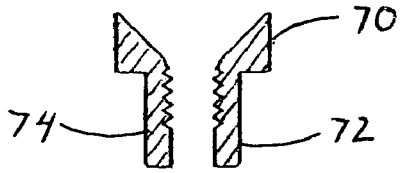
FIG. 4 is a schematic cross-sectional view along the longitudinal center plane of a tip ferrule according to a second embodiment of the present invention.

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims.

Referring to FIG. 1A, there is shown an example of a conventional cue stick 2. The cue stick 2 has a grip end 4 and a striking end 6. A player holds the cue stick with one hand on the cue shaft 8 proximate to the grip end 4 to thrust the striking end 6 toward a ball (not shown) while placing his other hand in sliding contact with the cue shaft 8 proximate the striking end 6 to guide the direction of the cue stick 2 during the thrust. A tip pad 10 is at the striking end 6 to contact the ball and transmit the thrust from the cue stick 2 to the ball. The tip pad 10 is fixed to a shaft ferrule 12 with a layer of adhesive (not shown) and the shaft ferrule is in turn adhesively fixed to the cue shaft 8. A bumper 14 is attached to the grip end 4 to protect that end of the cue stick 2.

Referring to FIG. 1B, there is shown a cue stick 16 according to an embodiment of the present invention. Like the conventional cue stick 2, the cue stick 16 has a grip end 4, a striking end 6, and a shaft 8. Unlike the conventional cue stick 2, the cue stick 16 has a detachable, i.e., removable, tip assembly 19 at its striking end 6. Some preferred embodiments of the tip assembly 19 are described below with reference to FIGS. 2-14.

Referring now to FIG. 2, there is shown a schematic cross-section of the tip ferrule 20 and a tip pad holder 22 of a tip assembly 24 according to a first embodiment of the present invention. The tip ferrule 20 has an outer cylindrical surface 26 and opposing first and second ends 28, 30. Extending from the first end 28 is a mortise 32 for receiving a tenon end 34 of the cue shaft 8 (see FIG. 3). The second end 30 of the tip ferrule 20 has a conical surface 36 which extends to the outer cylindrical surface 26 of the tip ferrule 20. At the apex of the conical surface 36 is a mortise 38, which has threads 40.

The tip pad holder 22 has an outer cylindrical surface 42 and opposing first and second ends 44, 46. The first end 44 has conical surface 48 which extends to the outer cylindrical surface 42. At the apex of the conical surface 48 is a tenon 50, which has threads 52. These threads 52 and the threads 40 of the mortise 32 of the tip ferrule 20 are complementary so that the tenon 50 of the tip pad holder 22 can be screwed into the mortise 32 to seat the conical surface 48 of the tip pad holder 22 on the conical surface 36 of the tip ferrule 20, as is illustrated in FIG. 3. The second end 46 of tip pad holder 22 is adapted to seat against the seating face 54 of a tip pad 56 (see FIG. 3).

The included angle of the conical surface 48 of the tip pad holder is selected to match that of the conical surface 36 of the tip ferrule 20. Preferably the included angle is in the range of about 45 degrees to about 140 degrees, and most preferably it is about 90 degrees. Angles shallower than about 45 degrees lack the requisite amount of lateral force resolution to maintain joint tightness against loosening whereas angles steeper than about 140 degrees tend to unduly elongate the tip pad holder.

Referring now to FIG. 3, there is shown a schematic cross-sectional view of the tip assembly 24 assembled on the end of cue shaft 8. The tip pad 56, having a seating face 54 and a striking face 58 and an outer cylindrical surface 60, is shown seated upon and adhesively attached to the second end 46 of the tip pad holder 22. The gap 62 indicates that the tenon 50 of the tip pad holder 22 is shorter than the mortise 38 of the tip ferrule 20. This gap 62 prevents the tenon 50 from contacting the end of the cue shaft 8 in a manner that would prevent the conical surface 48 of the tip pad holder 22 from seating upon the conical surface 36 of the tip ferrule 20. This seating is important to assure that the impact force resulting from tip pad 56 striking a ball is transmitted substantially uniformly across the diameter of the tip ferrule 20 and into the cue shaft 8 without a deflection of the tip pad holder 22.

The tip ferrule 20 is preferably adhesively attached to the cue shaft 8. It is also preferred that the inside cylindrical surface 64 of the mortise 32 of the tip ferrule 20 (see FIG. 2) has small spiral striations (not shown) or other surface roughenings to enhance the adhesive bonding between the tip ferrule 20 and the cue shaft 8.

Although in the first embodiment of the present invention shown in FIGS. 2 and 3 the conical surface 36 of the tip ferrule 20 is concave and receives the convex conical surface 48 of the tip pad holder 22, in other embodiments of the present invention, it is the conical surface of the tip pad holder which is concave and receives a convex conical surface of the tip ferrule.

The means of connecting the tip ferrule and the tip holder is not restricted to the threaded mortise/tenon joint described for the first embodiment of the present invention. For example, an apex mortise may be located in the convex member and a tenon at the apex of the concave member. Also, instead of threads, a bayonet-type of connection or a cam-lock connection, e.g., such as the cam-lock connection disclosed in U.S. Pat. No. 4,934,883, may be used with some embodiments of the present invention. In still other embodiments of the present invention, a polygonal mortise/tenon, e.g., a square mortise receiving a square tenon, is used in conjunction with a strip of adhesive tape surrounding the junction of the outside cylindrical surfaces of the tip ferrule and tip holder. In still other embodiments of the present invention, the respective conical surfaces of the tip ferrule and tip holder extend to an apex. In such embodiments, the connection between the tip ferrule and the tip pad holder may be maintained by the use of removable strip of adhesive tape surrounding the junction of the outside cylindrical surfaces of the tip ferrule and tip holder and/or through the use of an adhesive layer at the interface of the respective conical surfaces of the tip ferrule and tip holder. Where such an adhesive layer is used, it is to be chosen so that it may be broken when a preselected amount of torque is applied to the outer cylindrical surface of the tip pad holder, while yet providing sufficient strength to maintain the tip pad holder fixed in position during play.

The first embodiment of the present invention shown in FIGS. 2 and 3 has tip assembly 24 attached to the cue shaft 8 by way of a mortise/tenon joint in which the cue shaft tenon 34 is received into the mortise 32 of the tip ferrule 20. Other methods of connecting the tip assembly to the cue shaft are within the contemplation of the present invention. For example, the tip ferrule may be adapted to connect to a conventional shaft ferrule.

FIG. 4 shows a schematic cross-section of a tip ferrule 70 according to second embodiment of the present invention. The first end 72 of the tip ferrule 70 forms a tenon that is adapted to fit within a mortise of a shaft ferrule (not shown). The outer cylindrical surface 74 of the first end 72 is preferably roughened, e.g., with spiral striations (not shown), so as to enhance an adhesive bond with the corresponding shaft ferrule mortise. Alternatively, the outer cylindrical surface 74 may be threaded so as to screw into the threads of a corresponding shaft ferrule.

The tip ferrule and tip pad holder of the present invention may be made of any suitable material for use in the game in which the cue stick to be played. Characteristics to be taken into consideration in making the material selection are the density of the material (and hence the resulting weight of these components), the material's impact strength, its machinability or formability, and its resistance to impact fatigue fracture. Also important is the material's ability to produce an aesthetically pleasing surface. Preferably the tip ferrule and tip pad holder are made from a metal or a plastic or a carbon fiber composite. Preferable metals include aluminum alloys and brass.

The tip assembly of the present invention may include a tip pad holder tool that is usable for attaching and removing the tip holder to the tip ferrule. The tip pad holder tool may be adapted for use with more than one tip pad holder diameter. An example of such a tip holder tool that is adapted for use with two different diameter tip pad holders is shown in FIG. 5.

Figure 5:
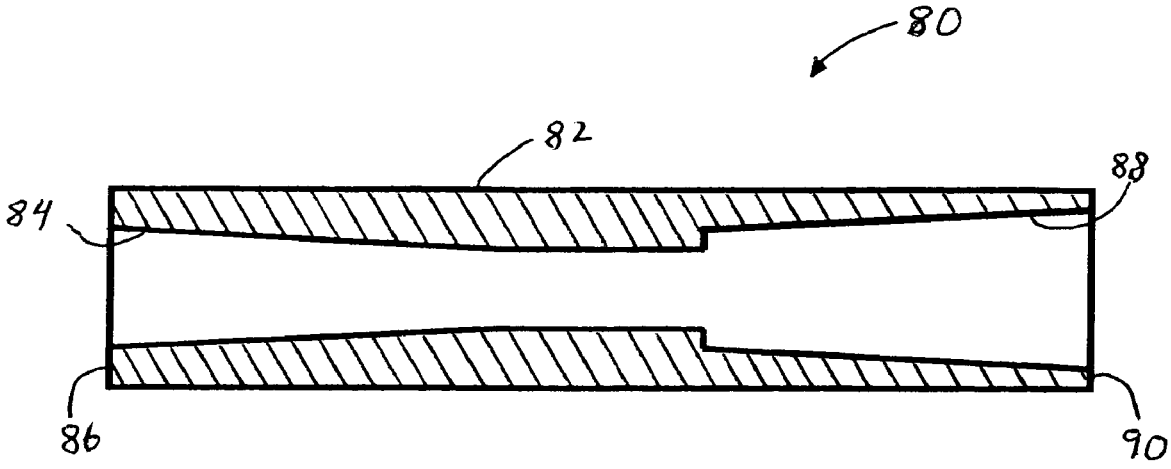
FIG. 5 is a schematic cross-sectional view along the longitudinal center plane of a tip pad holder removal tool according to an embodiment of the present invention.

Referring to FIG. 5, there is shown a schematic cross-sectional view of a tip pad holder tool 80 along a longitudinal center plane. The tip pad holder tool 80 has a cylindrical shape. Its outer surface 82 is adapted for manual gripping and preferably has surface features, e.g., flats or scores, or an elastomer gripping sleeve that prevents grip slippage. The tip pad holder tool 80 also has first inner surface 84 terminating at first end 86. First inner surface 84 is adapted to reversibly fit in interference contact with the cylindrical outer surface of a tip pad holder of a first diameter. The tip pad holder tool 80 also has second inner surface 88 terminating at second end 90. Second inner surface 88 is adapted to fit in interference contact with the cylindrical outer surface of a tip pad holder of a second, larger diameter.

The tip pad holder tool 80 may be used to attach a tip pad holder to a tip ferrule by first inserting a tip holder into the cavity 86 of the tip pad holder tool 80 until it comes into interference contact with the inner surface 84. The tip pad holder tool 80 is then manually manipulated to attach the tip pad holder to the tip ferrule. For example, where the tip pad holder and the tip ferrule are designed to connect by screwing together, the tip pad holder tool 80 is rotated around its longitudinal axis to tighten the tip pad holder into connection with the tip ferrule. The reverse operation is used to remove the tip pad holder from the tip ferrule.

The tip pad holder tool may be made of any suitable material or combinations of materials. Characteristics that are to be considered in material selection are the strength for the application, the machinability or formability of the material, its ability to be gripped without slipping, and the susceptibility the material has to scratching or marring the surface of the tip holder. Preferably, the material is a metal or a plastic, such as PVC.

Figure 14:
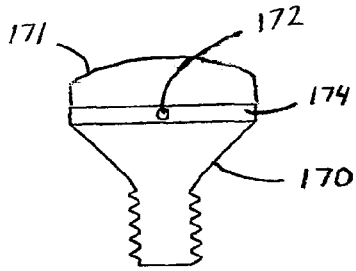
FIG. 14 is a schematic elevational view of a tip pad holder having a small hole for receiving a rod for loosening and tightening the domed tip pad holder according to an embodiment of the present invention.

In some embodiments, one or more holes are provided on the outer cylindrical surface of the tip pad holder for the insertion of a rod for the purpose of tightening and loosening the tip pad ferrule. For example, as shown in FIG. 14 which shows a schematic elevational view of a tip pad holder 170 carrying tip pad 171 according to an embodiment of the present invention which has a small hole 172 extending inwardly from its outer cylindrical surface 174. The hole 172 is adapted for removably receiving a rod which can be used to apply torque for loosening or tightening the dome-seated tip pad holder.

In the embodiments of the present invention depicted in FIGS. 1B-4, the tip ferrule 20 has a mortise 32 at the apex of its conical surface 36 and the tip pad holder 22 has a tenon 50 at the apex its conical surface 48. The opposite arrangement of mortise and tenon are also within the contemplation of the present invention and is depicted in the embodiments shown in FIGS. 6-9.

Figure 6:
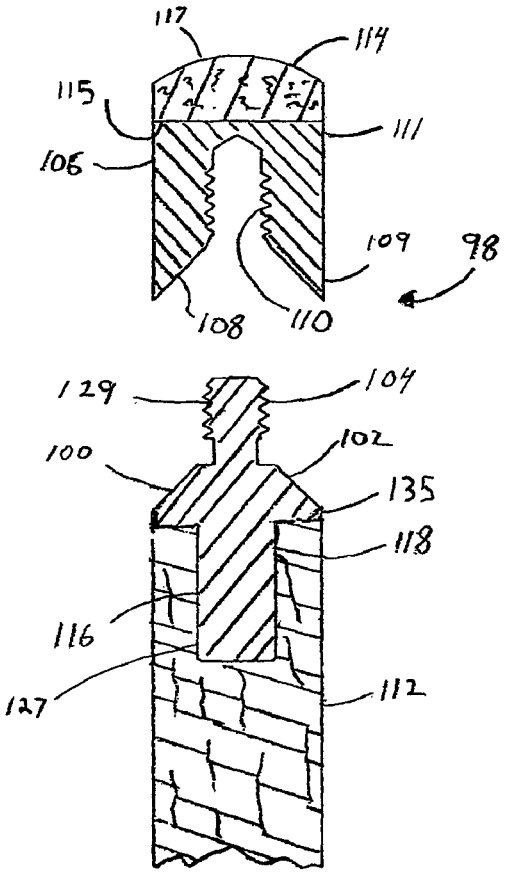
FIG. 6 is a schematic cross-sectional view along the center plane of the components of a tip assembly according to an embodiment of the present invention in which the tip pad holder has a mortise at the apex of its conical surface and a tip pad attached to its tip pad seating face and the tip ferrule has a tenon at the apex of its conical surface.
Figure 7:
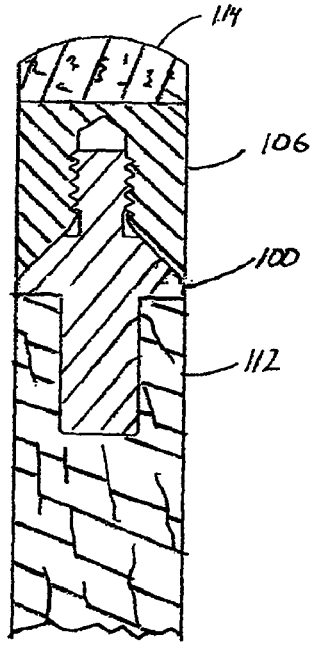
FIG. 7 is a schematic cross-sectional view along the center plane of the components of the tip assembly of FIG. 6 mounted together upon a cue shaft having a non-threaded mortise.

Referring now to FIGS. 6 and 7, there is shown a tip assembly 98 consisting of a tip ferrule 100 and a tip pad holder 106. The tip ferrule 100 has first end 127 which is adapted to be attached to the cue shaft 112. The tip ferrule 100 also has a cylindrical outer surface 135 and a second end 129 having a conical surface 102, which terminates on the cylindrical outer surface 135 and has at its apex a threaded tenon 104. The tip pad holder 106 has first and second ends 109, 111. The tip pad holder 106 has a conical surface 108 which has at its apex a threaded mortise 110 adapted to receive the threaded tenon 104. In FIG. 6, the tip ferrule 100 is shown as being mounted upon the end of the cue shaft 112. The tip pad holder 106 is also shown as having attached to it a tip pad 114. The seating face 115 of the tip pad 114 is opposite its striking face 117.

FIG. 7 shows the tip pad assembly 98 in its assembled state wherein it removeably attaches tip pad 114 to cue shaft 112.

Figure 8:
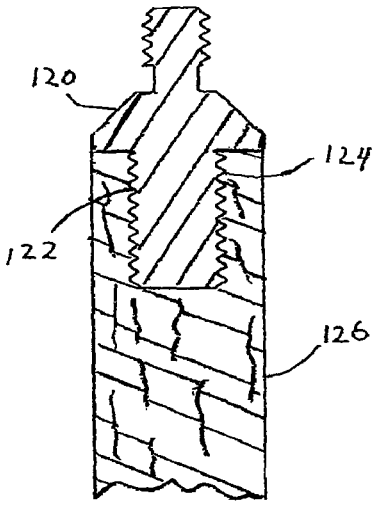
FIG. 8 is a schematic cross-sectional view along the center plane of the components of a tip ferrule according to an embodiment of the present invention mounted upon a cue shaft having a threaded mortise.
Figure 9:
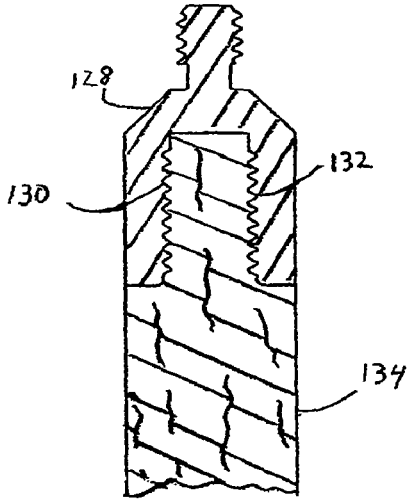
FIG. 9 is a schematic cross-sectional view along the center plane of the components of a tip ferrule according to an embodiment of the present invention mounted upon cue shaft having a threaded tenon.

In the embodiments depicted in FIGS. 6 and 7, the tip ferrule 100 has a non-threaded tenon 116 that is received within the non-threaded mortise 118 of the cue shaft 112. Some additional arrangements of attaching the tip ferrule to the cue shaft are shown in FIGS. 8 and 8. FIG. 8 shows an embodiment of the present invention wherein the tip ferrule 120 has a threaded tenon 122 which is received within the threaded mortise 124 of the cue shaft 126. Referring now to FIG. 9, the tip ferrule 128 has a threaded mortise 130 which receives the threaded tenon 132 of the cue shaft 134.

Figure 10:
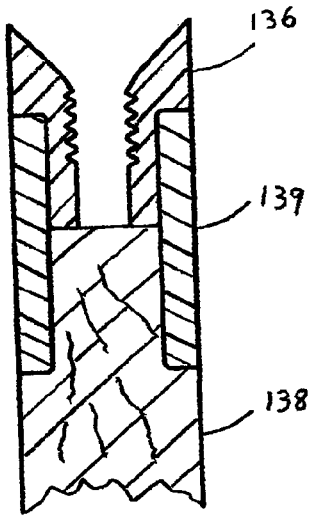
FIG. 10 is a schematic cross-section view along the longitudinal center plain of the components of a tip ferrule attached to a cue shaft by means of a shaft ferrule according to an embodiment of the present invention.

Referring to FIG. 10, there is shown an embodiment of the present invention in which a tip ferrule 136 is attached to a cue shaft 138 by means of a shaft ferrule 139.

Figure 11:
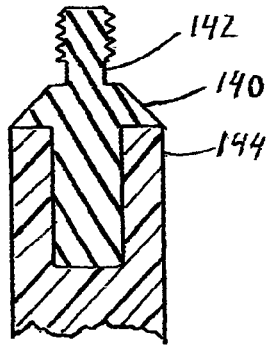
FIG. 11 is a schematic cross-sectional view along the longitudinal center plane of the components of tip ferrule having a conical surface which terminates on the outer peripheral surface of the tip ferrule according to an embodiment of the present invention.

It should be understood that although in the embodiments of the present invention described with regard to FIGS. 2-4 and 6-10 the conical surface of the tip ferrule, e.g., conical surface 36 tip ferrule 20 in FIGS. 2-3, terminates on an outer cylindrical surface of the tip ferrule, e.g., outer cylindrical surface 26 of tip ferrule 20, in some other embodiments of the present invention, the tip ferrule does not have an outer cylindrical surface upon which such termination occurs and the conical surface terminates at the outer radial periphery of the tip ferrule. FIG. 11 shows such an embodiment. There, the conical surface 140 of tip ferrule 142 terminates at the outer radial periphery 144 of the tip ferrule 142, but not at an outer cylindrical surface.

Figure 12:
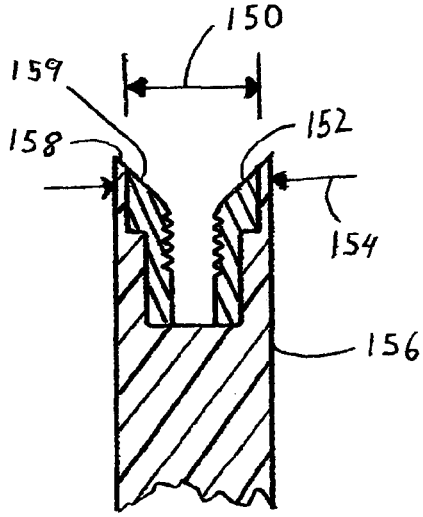
FIG. 12 is a schematic cross-sectional view along the longitudinal center plane of the components of a tip ferrule which has an outer radius that is less than that of the cue shaft upon which it is mounted according to an embodiment of the present invention.

It is also to be understood that although in the embodiments of the present invention described with regard to FIGS. 2-4 and 6-11 the outer radius of the tip ferrule is the same as the local diameter of the cue shaft or of a shaft ferrule, the present invention also includes embodiments in which the outer radius of the tip ferrule is either greater or less than that of the local diameter of the cue shaft or the shaft ferrule. One such embodiment of the present invention is shown in FIG. 12, in which the outer diameter 150 of the tip ferrule 152 is less than the local outer diameter 154 of the cue shaft 156. Another such embodiment of the present invention is shown in FIG.

Figure 15:
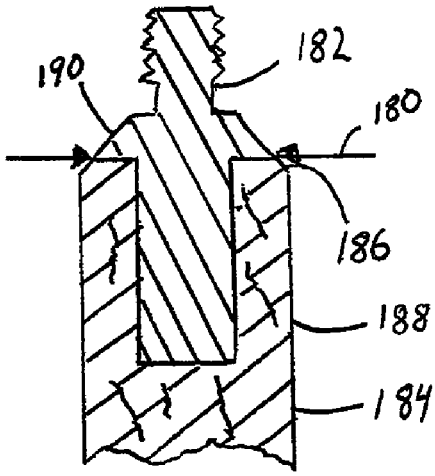
FIG. 15 is a schematic cross-sectional view along the longitudinal center plane of the components of a tip ferrule according to an embodiment of the present invention mounted on a cue shaft wherein the outer diameter of the outer radial periphery of the tip ferrule is less than the outer diameter of the cue shaft in the vicinity of the tip ferrule and the cue shaft has a conical surface which is an extension of the conical surface of the tip ferrule.
Figure 16:
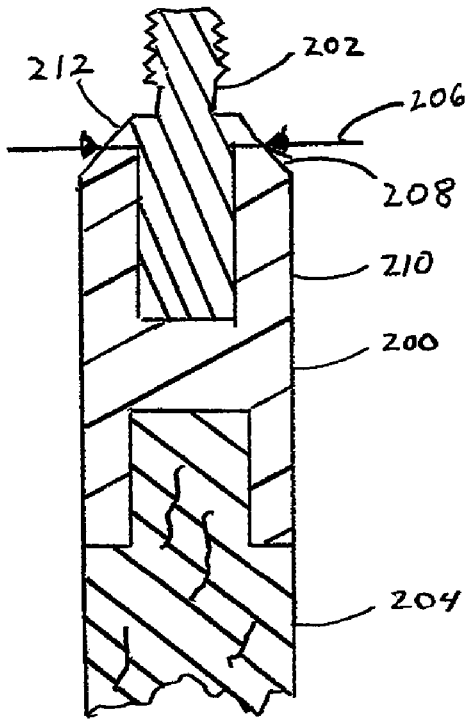
FIG. 16. is a schematic cross-sectional view along the longitudinal center plane of the components of a tip ferrule according to an embodiment of the present invention mounted on a shaft ferrule, which is in turn mounted on a cue shaft, wherein the outer diameter of the outer radial periphery of the tip ferrule is less than the outer diameter of the shaft ferrule in the vicinity of the tip ferrule and the shaft ferrule has a conical surface which is an extension of the conical surface of the tip ferrule.

13, in which the outer diameter 160 of the tip ferrule 162 is less than the local outer diameter 164 of the shaft ferrule 166. In yet another embodiment of the present invention, which is shown in FIG. 15, the outer diameter 180 of the tip ferrule 182 is less than the outer diameter of the cue shaft 184 in the vicinity of the tip ferrule 182. Here, the cue shaft 184 has a conical surface 186 terminating on its longitudinal surface 188 and its conical surface 186 is an extension of the conical surface 190 of the tip ferrule 182. The embodiment of the present invention shown in FIG. 16 is somewhat similar to that shown in FIG. 15, but in the one shown FIG. 16 there is a shaft ferrule 200 interposed between the tip ferrule 202 and the cue shaft 204. In this embodiment, the outer diameter 206 of the tip ferrule 202 is less than the outer diameter of the shaft ferrule 200 in the vicinity of the tip ferrule 202 and the shaft ferrule 200 has a conical surface 208 terminating on its longitudinal surface 210 and its conical surface 208 is an extension of the conical surface 212 of the tip ferrule 202. In such embodiments, it is important to make sure that the portion of the cue shaft or shaft ferrule which extends radially beyond the tip ferrule, e.g. conical surface 158 in FIG. 12 and conical surface 168 in FIG. 13 and conical surface 190 in FIG. 15 and conical surface 208 in FIG. 16, be constructed so that they act as extensions of the conical surface of the tip ferrule, e.g. of conical surface 159 in FIG. 12 and of conical surface 169 of FIG. 13 and conical surface 190 in FIG. 15 and conical surface 208 in FIG. 16, so that they complete the seating of the corresponding conical surface of the tip pad holder.

To be clear, it is to be understood that the present invention contemplates the use of tip pad holders such as those shown in FIGS. 2, 3, 6, 7, and 14, in conjunction with tip pads, e.g., as shown in FIGS. 3, 6, and 7, and in combination with the tip ferrules shown in FIGS. 2-4, 6-13, 15, and 16 having corresponding conical surfaces.

Figure 13:
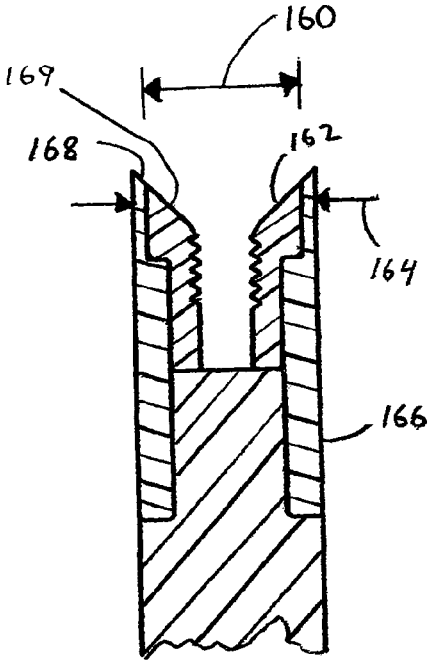
FIG. 13 is a schematic cross-sectional view along the longitudinal center plane of the components of a tip ferrule which has an outer radius that is less than that of the shaft ferrule by which it is attached to a cue shaft according to an embodiment of the present invention.

The present invention also includes embodiments comprising a tip assembly of the type described in the above embodiments of the present invention in combination with a cue shaft. In some such embodiments, the tip assembly is attached directly to the cue shaft, e.g., as is shown in FIG. 3, or is attached to some intermediate structure, such as a shaft ferrule, e.g., as shown in FIGS. 10 and 13. Some embodiments also include a tip holder tool, such as that described above, that is usable for attaching and removing the tip pad holder.

While only a few embodiments of the present invention have been shown and described, it will be obvious to those skilled in the art that many changes and modifications may be made thereunto without departing from the spirit and scope of the invention as described in the following claims. All United States patents and United States published patent applications referred to herein are incorporated herein by reference as if set forth in full herein.

What is claimed is:

1. A tip assembly for the tip end of a cue stick, said tip assembly comprising:

a) a tip ferrule having an outer radial periphery and opposing first and second ends, said first end being adapted to attach to said cue stick, and said second end having a non-threaded conical surface terminating on said outer radial periphery of said tip ferrule; and b) a tip pad holder having a cylindrical outer surface and opposing first and second ends, said first end having a non-threaded conical surface terminating on said cylindrical outer surface of said tip pad holder, and said second end being adapted to receive a seating face of a tip pad;

wherein said tip assembly may be assembled for use by removably seating the non-threaded conical surface of the first end of said tip pad holder upon the non-threaded conical surface of the second end of said tip ferrule and said tip ferrule does not have an outer cylindrical surface that intersects the conical surface of the tip ferrule.

2. The tip assembly of claim 1, further comprising a tip pad having a circular cross-section and a striking face and a seating face, wherein said seating face is adapted to be received by said second end of said tip pad holder.

3. The tip assembly of claim 1, wherein the outer cylindrical surface of the tip pad holder has a hole adapted for receiving a rod for loosening and tightening said tip pad holder on said tip ferrule.

4. A cue stick comprising:

a) a striking end;

b) a cue shaft; and c) a tip assembly having:

i) a tip ferrule having a radial outer periphery and opposing first and second ends, said first end being adapted to attach to said cue stick, and said second end having a non-threaded conical surface terminating on said radial outer periphery of said tip ferrule;

ii) a tip pad holder having a cylindrical outer surface and opposing first and second ends, said first end having a non-threaded conical surface terminating on said cylindrical outer surface of said tip pad holder, and said second end being adapted to receive a seating face of a tip pad;

wherein said tip assembly may be assembled for use by removably seating the non-threaded conical surface of the first end of said tip pad holder upon the non-threaded conical surface of the second end of said tip ferrule and said tip ferrule does not have an outer cylindrical surface that intersects the conical surface of the tip ferrule;

wherein said tip assembly is attached to the striking end of said cue stick.

5. The cue stick of claim 4, further comprising a tip pad having a circular cross-section and a striking face and a seating face, wherein said seating face is adapted to be received by said second end of said tip pad holder.

6. The cue stick of claim 4, wherein the outer diameter of the outer radial periphery of said tip ferrule is less than the outer diameter of said cue shaft in the vicinity of said tip ferrule and said cue shaft has outer longitudinal surface and a conical surface terminating on that outer longitudinal surface, the conical surface of the cue shaft being an extension of the conical surface of said tip ferrule.

7. The cue stick of claim 4, further comprising a shaft ferrule having a first end adapted to attach to said cue shaft and a second end adapted to attach to said tip ferrule, wherein said tip ferrule is attached to said cue shaft by means of said shaft ferrule.

8. The cue stick of claim 7, wherein the outer diameter of the outer radial periphery of said tip ferrule is less than the outer diameter of said shaft ferrule in the vicinity of said tip ferrule and said shaft ferrule has outer longitudinal surface and a conical surface terminating on that outer longitudinal surface, the conical surface of the shaft ferrule being an extension of the conical surface of said tip ferrule.

9. The cue stick of claim 4, wherein the outer cylindrical surface of the tip pad holder has a hole adapted for receiving a rod for loosening and tightening said tip pad holder with respect to said tip ferrule.

10. A cue stick comprising:

a) a striking end;

b) a cue shaft;

c) a shaft ferrule; and d) a tip assembly having:

i) a tip ferrule having an outer cylindrical surface and opposing first and second ends, said first end being adapted to attach to said cue stick, and said second end having a non-threaded conical surface terminating on said outer cylindrical surface of said tip ferrule;

ii) a tip pad holder having a cylindrical outer surface and opposing first and second ends, said first end having a non-threaded conical surface terminating on said cylindrical outer surface of said tip pad holder, and said second end being adapted to receive a seating face of a tip pad;

wherein said tip assembly may be assembled for use by removably seating the non-threaded conical surface of the first end of said tip pad holder upon the non-threaded conical surface of the second end of said tip ferrule;

wherein said tip assembly is attached to the striking end of said cue stick by way of said shaft ferrule and the outer diameter of the outer cylindrical surface of said tip ferrule is less than the outer diameter of said shaft ferrule in the vicinity of said tip ferrule and said shaft ferrule has an outer longitudinal surface and a conical surface terminating on that outer longitudinal surface, the conical surface of the shaft ferrule being an extension of the conical surface of said tip ferrule.

11. The cue stick of claim 10, further comprising a tip pad having a circular cross-section and a striking face and a seating face, wherein said seating face is adapted to be received by said second end of said tip pad holder.

12. The cue stick of claim 10, wherein the outer cylindrical surface of the tip pad holder has a hole adapted for receiving a rod for loosening and tightening said tip pad holder with respect to said tip ferrule.

13. A cue stick comprising:

a) a striking end;

b) a cue shaft; and c) a tip assembly having:

i) a tip ferrule having an outer cylindrical surface and opposing first and second ends, said first end being adapted to attach to said cue stick, and said second end having a non-threaded conical surface terminating on said outer cylindrical surface of said tip ferrule;

ii) a tip pad holder having a cylindrical outer surface and opposing first and second ends, said first end having a non-threaded conical surface terminating on said cylindrical outer surface of said tip pad holder, and said second end being adapted to receive a seating face of a tip pad;

wherein said tip assembly may be assembled for use by removably seating the non-threaded conical surface of the first end of said tip pad holder upon the non-threaded conical surface of the second end of said tip ferrule;

wherein the outer diameter of the outer cylindrical surface of said tip ferrule is less than the outer diameter of said cue shaft in the vicinity of said tip ferrule and said cue shaft has outer longitudinal surface and a conical surface terminating on that outer longitudinal surface, the conical surface of said cue shaft being an extension of the conical surface of said tip ferrule, and said tip assembly is attached to the striking end of said cue stick.

14. The cue stick of claim 13, further comprising a tip pad having a circular cross-section and a striking face and a seating face, wherein said seating face is adapted to be received by said second end of said tip pad holder.

15. The cue stick of claim 13, wherein the outer cylindrical surface of the tip pad holder has a hole adapted for receiving a rod for loosening and tightening said tip pad holder with respect to said tip ferrule.

16. A cue stick comprising:

a) a striking end;

b) a cue shaft;

c) a shaft ferrule; and d) a tip assembly having:

i) a tip ferrule having an outer cylindrical surface and opposing first and second ends, said first end being adapted to attach to said cue stick, and said second end having a non-threaded conical surface terminating on said outer cylindrical surface of said tip ferrule; and ii) a tip pad holder having a cylindrical outer surface and opposing first and second ends, said first end having a non-threaded conical surface terminating on said cylindrical outer surface of said tip pad holder, and said second end being adapted to receive a seating face of a tip pad;

wherein said tip assembly may be assembled for use by removably seating the non-threaded conical surface of the first end of said tip pad holder upon the non-threaded conical surface of the second end of said tip ferrule;

wherein said tip assembly is attached to the striking end of said cue stick by way of said shaft ferrule.

17. The cue stick of claim 16, further comprising a tip pad having a circular cross-section and a striking face and a seating face, wherein said seating face is adapted to be received by said second end of said tip pad holder.

18. The cue stick of claim 16, wherein the outer cylindrical surface of the tip pad holder has a hole adapted for receiving a rod for loosening and tightening said tip pad holder with respect to said tip ferrule.

* * * * *